US005115275A

United States Patent [19]

Suzuki

[11] Patent Number: 5,115,275

[45] Date of Patent: May 19, 1992

[54] DEVELOPING UNIT FOR AN IMAGE RECORDING APPARATUS

[75] Inventor: Minoru Suzuki, Yokohama, Japan

[73] Assignee: Ricoh Company, Ltd., Tokyo, Japan

[21] Appl. No.: 531,702

[22] Filed: Jun. 1, 1990

[30] Foreign Application Priority Data

| | | | |
|---|---|---|---|
| Jun. 2, 1989 | [JP] | Japan | 1-139186 |
| Jul. 7, 1989 | [JP] | Japan | 1-174199 |
| Jul. 12, 1989 | [JP] | Japan | 1-178178 |
| Feb. 23, 1990 | [JP] | Japan | 2-41232 |

[51] Int. Cl.[5] ..... G03G 15/06; G03G 21/00

[52] U.S. Cl. ..... 355/245; 355/246; 355/260

[58] Field of Search ..... 355/245, 246, 260

[56] References Cited

U.S. PATENT DOCUMENTS

| | | | |
|---|---|---|---|
| 4,607,939 | 8/1986 | Saito | 355/245 X |
| 4,668,074 | 5/1987 | Hirozane | 355/245 X |
| 4,952,976 | 8/1990 | Katoh et al. | 355/246 X |
| 4,961,088 | 10/1990 | Gilliland et al. | 355/260 X |
| 4,974,020 | 11/1990 | Takamatsu et al. | 355/245 X |
| 5,017,962 | 5/1991 | Tsuji et al. | 355/245 X |

*Primary Examiner*—Fred L. Braun

*Attorney, Agent, or Firm*—Oblon, Spivak, McClelland, Maier & Neustadt

[57] ABSTRACT

A developing unit usable with and removably mounted on a copier, printer, facsimile machine or similar image recording apparatus. When the developing unit reaches the end of a predetermined service life thereof as counted in terms of, for example, the number of times that a toner end condition has occurred, it is prevented from being loaded again on the body of the image recording apparatus and, at the same time, the user is clearly informed of the time for replacement of the developing unit.

17 Claims, 15 Drawing Sheets

DEVELOPING UNIT FOR AN IMAGE RECORDING APPARATUS

BACKGROUND OF THE INVENTION

The present invention relates to a developing unit usable with and removably mounted on a copier, printer, facsimile machine or similar image recording apparatus.

Many of image recording apparatuses of the type described such as copiers available today are designed for personal use. A current trend in the field of personal copiers is toward the construction of various replaceable parts into a unit which would promote the replacement by users instead of servicemen. However, a problem with a developing unit, for example, is that various replaceable parts including the body of the unit and a developer which is expendable have to be replaced altogether despite that the service life differs from one part to another. Discarding even those parts which are still usable increases the running cost per copy. In the light of this, there has been proposed a system which combines a plurality of cartridges with a single developing unit and determines that the life of the unit has expired when a predetrmined number of cartridges have been successively used and emptied. For example, Japanese Patent Laid-Open Publication (Kokai) Nos. 87464/1984 and 124052/1986 each discloses a developing unit having a developing roller and a toner cartridge and counting toner cartridges which are loaded in the unit one after another. After the developing unit has been operated with a predetermined number of successive toner cartridges, any other toner cartridge is inhibited from being located in the unit. Japanese Patent Laid-Open Publication No. 75756/1988 proposes a developing unit which is loaded with a plurality of toner cartridges one at a time in a predetermined order and, when loaded with the last toner cartridge, does not allow it from being removed later and thereby inhibits the use of new cartridges.

The prior art schemes discussed above have a drawback that when the user supplies a toner without using a cartridge, i.e., by using a spoon or the like, a counter associated with a developing unit does not function at all. Then, the actual state of use of the developing unit fails to coincide with the life of the unit being displayed, resulting in machine troubles and unusual images.

A color copier for personal use is also extensively used which is selectively operable with some developing units each being loaded with a developer of different color. Generally, such developing units each has a developing section and a toner storing section which are formed integrally with each other. When the copying operation has been executed with any one of such developing units a number of times which matches the amount of toner stored therein, the developing unit is bodily replaced with another.

However, with the conventional system stated above, it is impossible for the user to clearly see if the individual developing units are still usable. Specifically, the user cannot see if a defect occurs in an image unless the user actually mounts desired one of the developing units on the apparatus body.

SUMMARY OF THE INVENTION

It is therefore an object of the present invention to provide a developing unit for an image recording apparatus which, when reached the end of the life, inhibits further supply of developer to thereby eliminate troubles and unusual images, while clearly showing the user of the life of the unit and the time for replacement.

It is another object of the present invention to provide a developing unit for an image recording apparatus which allows the life thereof to be measured even when a toner bottle is used in place of a comparatively expensive toner cartridge.

It is another object of the present invention to provide a developing unit for an image recording apparatus which eliminates troubles due to the use of the unit after a toner end condition has been reached and reduces the running cost in relation to user maintenance.

It is another object of the present invention to provide a generally improved developing unit for an image recording apparatus.

In accordance with the present invention, a developing unit removably mounted on an image recording apparatus comprises a developer chamber for storing a developer fed from the outside, a detecting element for detecting the amount of the developer remaining in the developer chamber, a counter operated by an output signal of the detecting element, a cover member openably closing the developer chamber, and a locking member for locking the cover member when the counter reaches a predetermined value.

Also, in accordance with the present invention, a developing unit removably mounted on an image recording apparatus comprises a developer chamber for storing a developer fed from the outside, a detecting element for detecting the amount of the developer remining in the developer chamber, a counter operated by an output signal of the detecting element, and a preventing member for preventing the developing unit from being mounted again on a body of the image recording apparatus when the counter reaches a predetermined value.

Further, in accordance with the present invention, in a developing unit having a developing chamber and a toner chamber and removably mounted on a body of an image recording apparatus, when an amount of a developer, an amount of a toner or a toner concentration of a developer is lowered below a predetermined value, the developing unit is prevented from being mounted again on the body of the image recording apparatus by being worked upon by the body of the image recording apparatus.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the developing unit for an image recording apparatus in accordance with the present invention will be described with reference to the accompanying drawings.

FIRST EMBODIMENT

Figure 1:
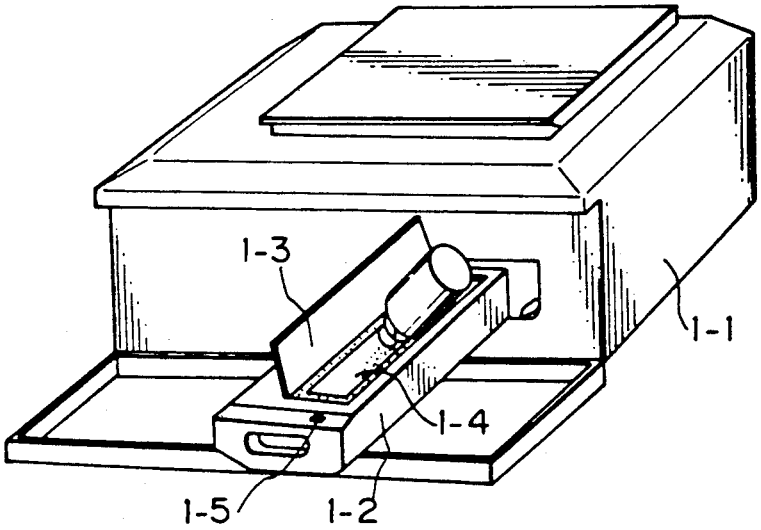
FIG. 1 is a perspective view showing a developing unit embodying the present invention and a copier body with which the developing unit is usable.

Referring to FIG. 1, a developing unit embodying the present invention is shown and applied to a copier by way of example. As shown, the developing unit, generally 1-2, is mounted and dismounted from a copier body 1-1 at the front end of the latter. The developing unit 1-2 has a toner chamber 1-4, a cover 1-3 openably closing the toner chamber 1-4, and a window 1-5 which will be described.

Figure 2:
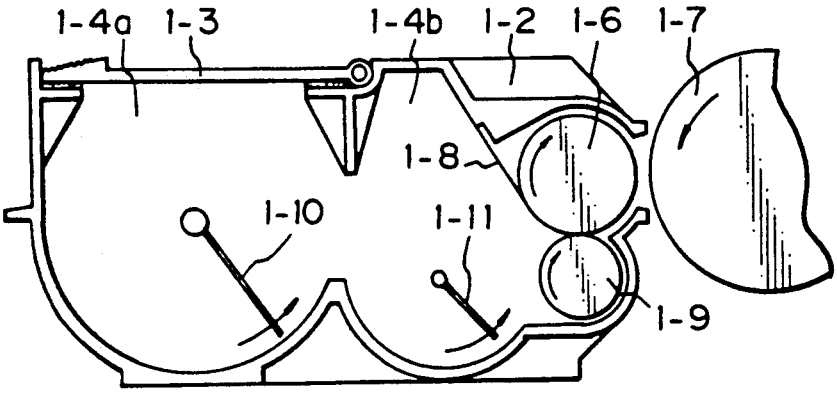
FIG. 2 is a sectional side elevation showing mainly a storing chamber section of the illustrative embodiment.

FIG. 2 shows the toner chamber 1-4 of the developing unit 1-2 in detail. As shown, a developing roller 1-6 is disposed in the toner chamber 1-4 and faces a photoconductive element 1-7. The developing unit 1-2 has a metering blade 1-8 and a supply roller 1-9 which are held in contact with the developing roller 1-6, and it is of the type using a one-component developer. The toner chamber 1-4 is made up of two contiguous portions 1-4*a* and 1-4*b* which have thereinside toner transport members 1-10 and 1-11, respectively. The toner transport member 1-10 also plays the role of toner end detecting means. Specifically, the toner transport member 1-10 is rotatable in a direction indicated by an arrow in the figure so as to agitate a toner in the chamber portion 1-4*a*. Hence, the amount of remaining toner and toner end can be detected in terms of the moment of the toner transport member 1-10 which varies with the amount of toner. The developing unit 1-2 is of the type having a predetermined service life to be operable in optimum conditions and being bodily replaced on completing a developing operation a predetermined number of times, as discussed earlier. The service life is usually longer that the time in which the toner chamber 1-4 runs out of the toner, and it is associated with a plurality of toner cartridges or toner bottles.

As FIG. 1 indicates, when a toner end condition is displayed, the user pulls out the developing unit 1-2 from the copier body 1-1, opens the cover 1-3, and then supplies a toner into the uncovered toner chamber 1-4 by using a toner cartridge or a toner bottle. The developing unit 1-2 is provided with an implementation for inhibiting the supply of fresh toner, informing the user of the end of the life of the developing unit 1-2, and clearly showing the time for replacement when it undergoes a predetermined number of copying cycles, as will be described hereinafter.

Figure 3:
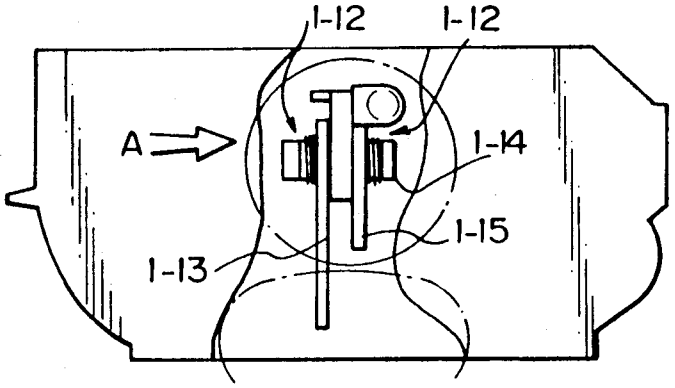
FIG. 3 is a sectional side elevation showing mainly a bearing portion included in the illustrative embodiment.
Figure 4:
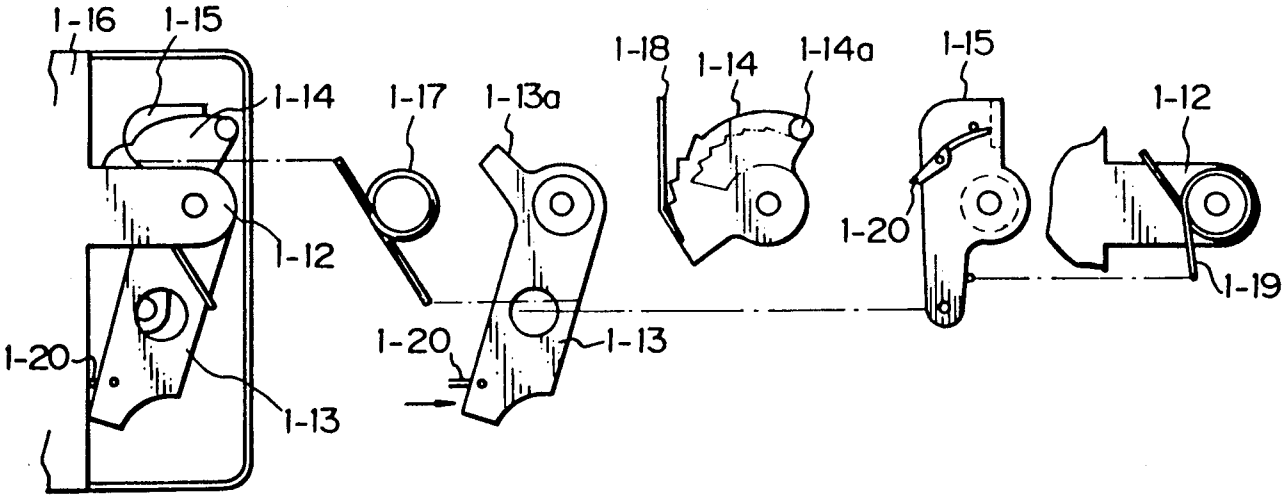
FIG. 4 is an exploded view as seen in a direction indicated by an arrow A in FIG. 3.

As shown in FIG. 3, the developing unit 1-2 has a bearing portion which includes a bearing 1-12, an arm 1-13, a ratchet wheel 1-14, and an arm 1-15. FIG. 4 is an exploded view of the arrangement of FIG. 3 as seen in a direction A. As shown in FIG. 4, the arm 1-13, ratchet wheel 1-14, a ratchet or pawl 1-18 associated with the ratchet wheel 1-14, and the arm 1-15 are sequentially arranged between a side panel 1-16 and the bearing 1-12 which is formed integrally with the side panel 1-16. The arm 1-13 is constantly biased clockwise by a spring 1-17, while the arm 1-15 is constantly biased clockwise by a spring 1-19 and has a pawl 1-20. Every time the arm 1-15 is rotated counterclockwise, it rotates the ratchet wheel 1-14 counterclockwise with its pawl 1-20. As a pin 1-14*a* studded on the ratchet wheel 1-14 urges a lug 1-13*a* extending out from the arm 1-13, the arm 1-13 is rotated counterclockwise. Specifically, when a solenoid mounted on the copier body 1-1 as will be described is energized by a toner end signal, it rotates the arm 1-15 as mentioned above. As a result, the ratchet wheel 1-14 is rotated by one tooth every time the toner end signal appears. As soon as a predetermined number of toner cartridges or toner bottles are used, the pin 1-14*a* of the ratchet whell 1-14 rotates the arm 1-13 counterclockwise, as will be described with reference to FIG. 7. Then, the arm 1-13 pulls a piano wire 1-20 anchored to one end of the arm 1-13, in a direction indicated by an arrrow in FIG. 4.

Figure 5:
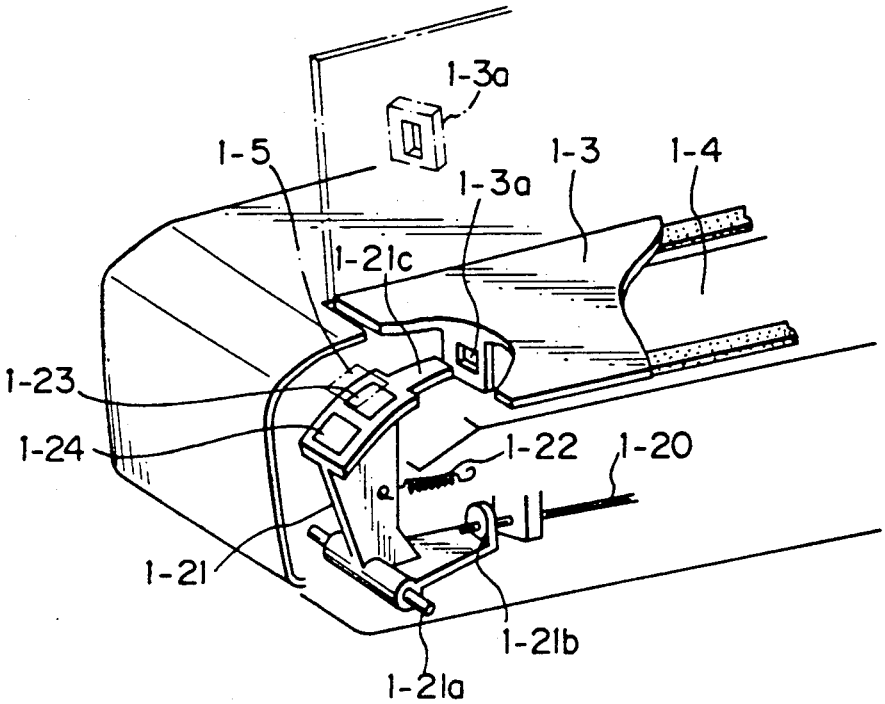
FIGS. 5 and 6 are partly taken away perspective views showing an essential part of the illustrative embodiment.
Figure 6:
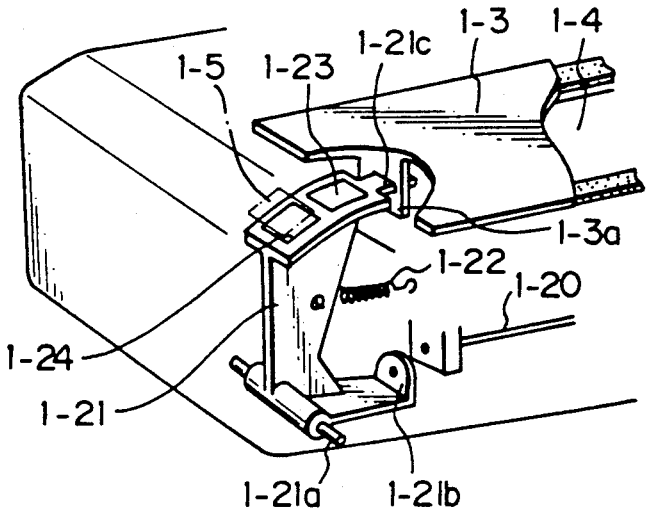

FIGS. 5 and 6 show an essential part of the developing unit 1-2 more specifically, i.e., FIG. 5 shows the cover 1-3 in an unlocked state which FIG. 6 shows it in a locked state. Usually, the user supplies a toner from a toner cartridge or a toner bottle into the toner chamber 1-4 by opening the cover 1-3. As shown in FIG. 5, a locking member 1-21 is constantly biased clockwise about a shaft 1-21*a* by a spring 1-22. However, when the piano wire 1-20 is engaged with an anti-rotation portion 1-21*b* of the locking member 1-21, the rotation of the locking member 1-21 is inhibited. In this condition, a display 1-23 shows itself through the window 1-5 of the developing unit 1-2 to inform the user of the usable state of the unit 1-2. As shown in FIG. 6, when the piano wire 1-20 is pulled out from the anti-rotation portion 1-21*b* of the locking member 1-21 in response to the previously mentioned toner end signal, the locking member 1-21 is rotated clockwise by the spring 1-22 until a lug 1-21*c* thereof mates with a hole 1-3*a* which is formed in the cover 1-3. Then, another display 1-24 shows itself through the window 1-5 to indicate that the developing unit 1-2 is not usable. In this condition, even through the developing unit 1-2 may be pulled out of the copier body 1-1, the cover 1-3 cannot be moved to thereby inhibit the supply of fresh toner. At this instant, the user will see that the life of the developing unit 1- 2 has expired.

Figure 7:
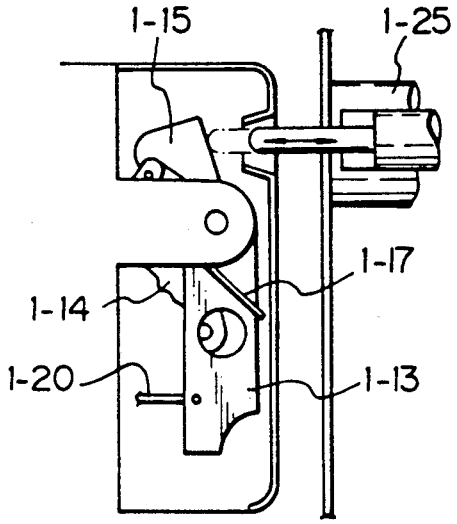
FIG. 7 is a side elevation demonstrating the movements of arms caused by a solenoid.

As shown in FIG. 7, when a solenoid 1-25 is energized as stated eariler, it urges the arm 1-15 which in turn urges the ratchet wheel 1-14 counterclockwise with its pawl 1-20. As a result, the ratchet wheel 1-14 drives the arm 1-13 counterclockwise with its pin 1-14*a*, thereby pulling the piano wire 1-20 in the direction indicated by the arrow. The ratchet wheel 1-14 and the locking member 1-21 serve as a counter and a lock, respectively.

SECOND EMBODIMENT

Figure 8:
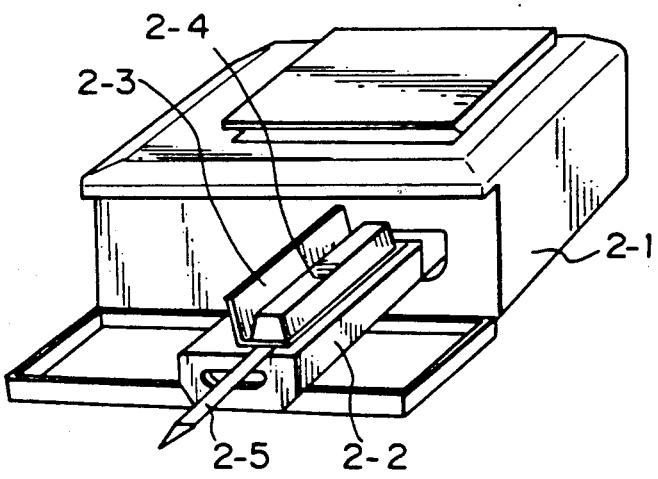
FIG. 8 is a prespective view showing an alternative embodiment of the present invention and a copier body with which is operable.

Referring to FIG. 8, an alternative embodiment of the present invention will be described. As shown, the developing unit, generally 2-2, is inserted into and removed from a copier body 2-1 at the front end of the latter. The developing unit 2-2 has a cover 2-3 openably closing a toner chamber which will be described, a toner cartridge 2-4, and a seal 2-5 removably sealing the toner cartridge 2-4.

Figure 9:
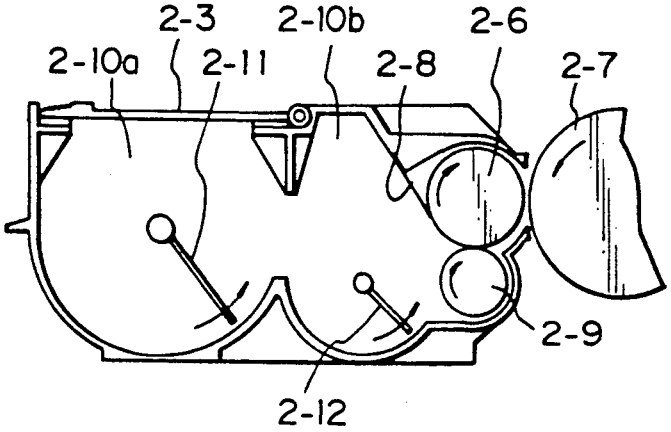
FIGS. 9 and 10 are sectional side elevations showing mainly a storing chamber section of the alternative embodiment.
Figure 10:
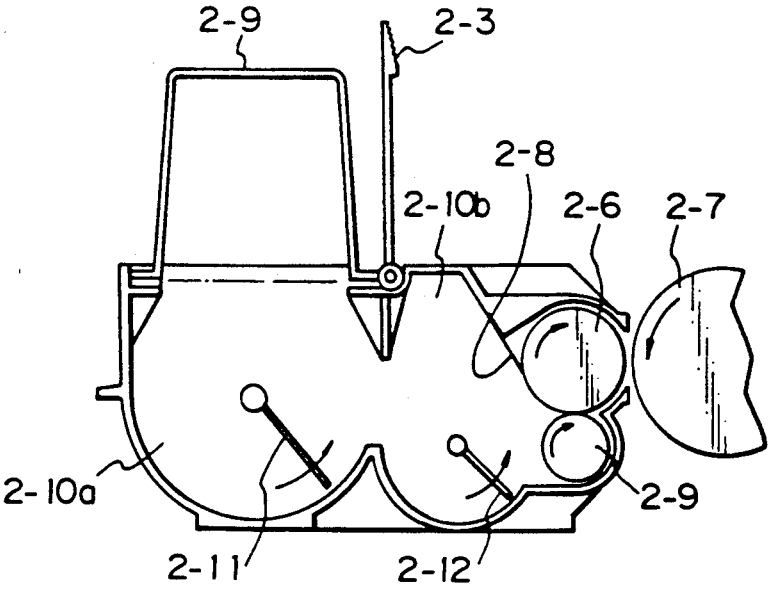

FIGS. 9 and 10 show the toner chamber of the developing unit 2-2 in detail. As shown, a developing roller 2-6 is located to face a photoconductive elements 2-7. The developing unit 2-2 has a metering blade 2-8 and a supply roller 2-9 which are held in contact with the developing roller 2-6, and it is of the type using a one-component developer. The toner chamber is made up of two contiguous portions 2-10*a* and 2-10*b* which have thereinside toner transport members 2-11 and 2-12, respectively. The toner transport member 2-11 also plays the role of toner end detecting means. Specifically, the toner transport member 2-11 rotatable in a direction indicated by an arrow in the figure so as to agitate a toner in the chamber portion 2-10*a*. Hence, the amount of remaining toner and toner end can be detected in terms of the moment of the toner transport member 2-11 which varies with the amount of toner. The developing unit 2-2 is of the type having a predetermined service life to be operable in optimum conditions and being bodily replaced on completing a predetermined number of copying cycles, as discussed earlier. The service life is usually longer than the time in which the toner chamber 1-4 runs out of the toner, and it is associated with a plurality of toner cartridges or toner bottles.

As FIG. 8 indicates, when a toner end condition is displayed, the user pulls out the developing unit 2-2 from the copier body 2-1, opens the cover 2-3 to uncover the toner chamber 2-10*a*, loads the toner cartridge in the toner chamber, and then removes the seal 2-5. The developing unit 2-2 is provided with an implementation for inhibiting a new toner cartridge 2-4 from being loaded in the developing unit 2-2 and for preventing the unit 2-2 itself from being mounted again on the copier body. This is successful in informing the user of the end of the life of the deleloping unit 1 and clearly showing the time for replacement.

Figure 11:
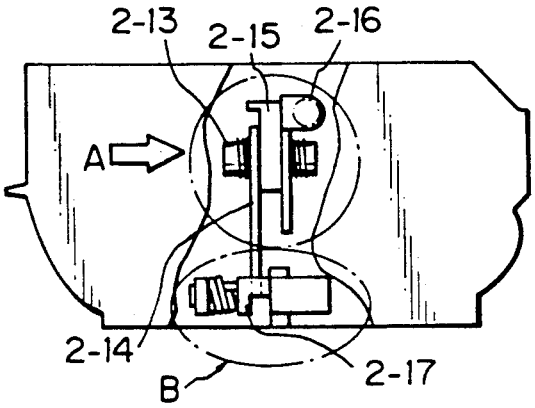
FIG. 11 is a view of an essential part of the alternative embodiment.
Figure 12:
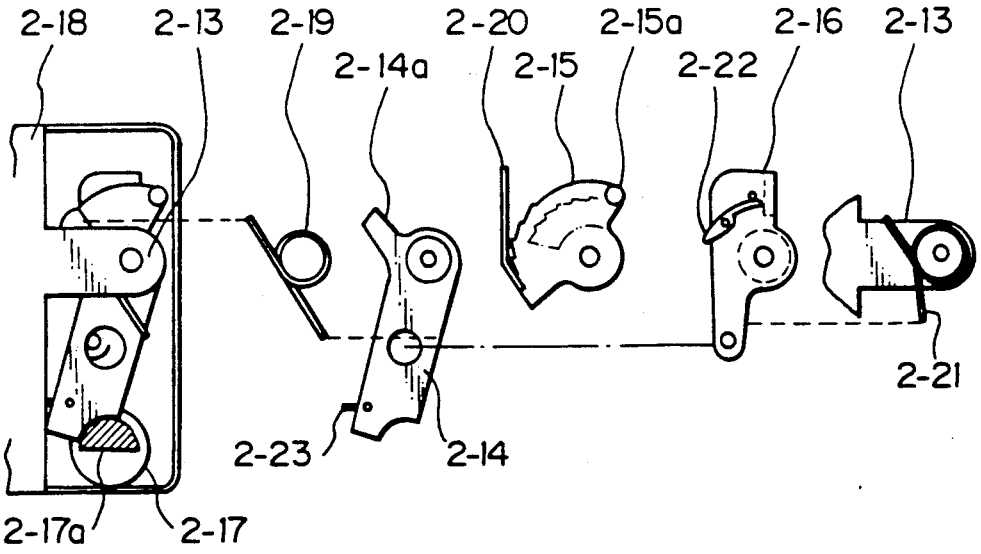
FIG. 12 is an exploded view as seen in a direction indicated by an arrow A in FIG. 11.
Figure 15:
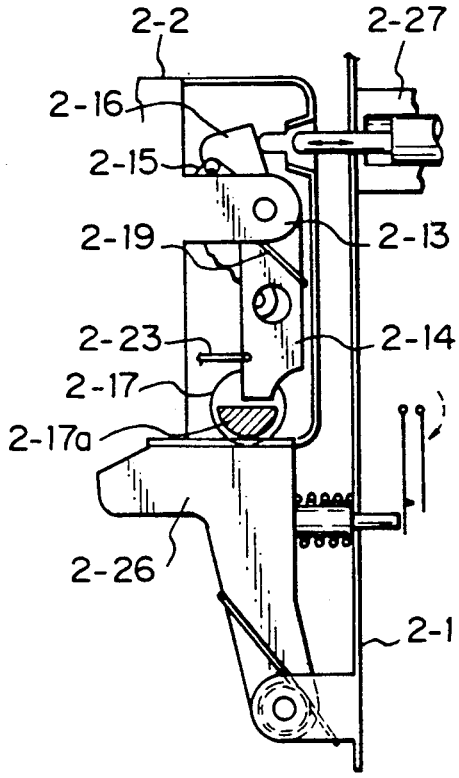

FIG. 11 is a fragmentary view of the developing unit 2-2 and shows a bearing portion which is located at the rear side of the arrangement of FIGS. 9 and 10. In the figure, there are shown a bearing 2-13, an arm 2-14, a ratchet wheel 2-15, an arm 2-16, and a gear 2-17. FIG. 12 is an exploded view as seen in a direction indicated by an arrow A in FIG. 11. As shown, the arm 2-14, the ratchet wheel 2-15, a ratchet or pawl 2-20, and the arm 2-16 are sequentially arranged between a side panel 2-18 and the bearing 2-13 which is formed integrally with the side panel 2-18. The arm 2-14 is constantly biased clockwise by a spring 2-19, while the arm 2-16 is constantly biased clockwise by a spring 2-21 and has a pawl 2-22. Every time the arm 2-16 is rotated counterclockwise, it rotates the ratchet wheel 2-15 counterclockwise with its pawl 2-22. As a pin 2-15*a* studded on the ratchet wheel 2-15 urges a lug 2-14*a* extending out from the arm 2-14, the arm 2-14 is rotated counterclockwise. Specifically, when a solenoid mounted on the copier body as will be described is energized by a toner end signal, it rotates the arm 2-16 as mentioned above. As a result, the ratchet wheel 2-15 is rotated by one tooth every time the toner end signal appears. As soon as a predetermined number of toner cartridges are used, the pin 2-15*a* of the ratchet wheel 2-15 rotates the arm 2-14 counterclockwise, as will be described with reference to FIG. 15. Then, the arm 2-14 pulls a piano wire 2-23 anchored to one end of the arm 2-14, in a direction indicated by an arrow.

Figure 13:
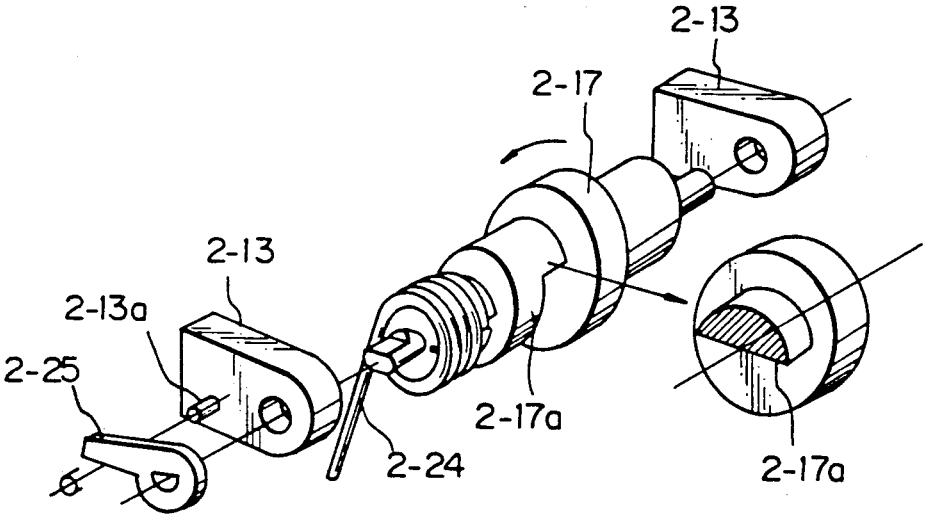
FIG. 13 is an exploded perspective view of a portion indicated by an arrow B in FIG. 11.

FIG. 13 shows a portion indicated by an arrow B in FIG. 11 in detail. The gear 2-17 is constantly biased by a torsion spring 2-24 as indicated by an arrow in the figure. Usually, however, the pin 2-13*a* of the bearing portion 2-13 an arm 2-25 which is rotatable integrally with the gear 2-17 are held in abutment to prevent the gear 2-17 from rotating. In this condition, a semicircular lug 2-17*a* provided on the gear 2-17 has its flat edge facing downward (as viewed in a section).

Figure 14:
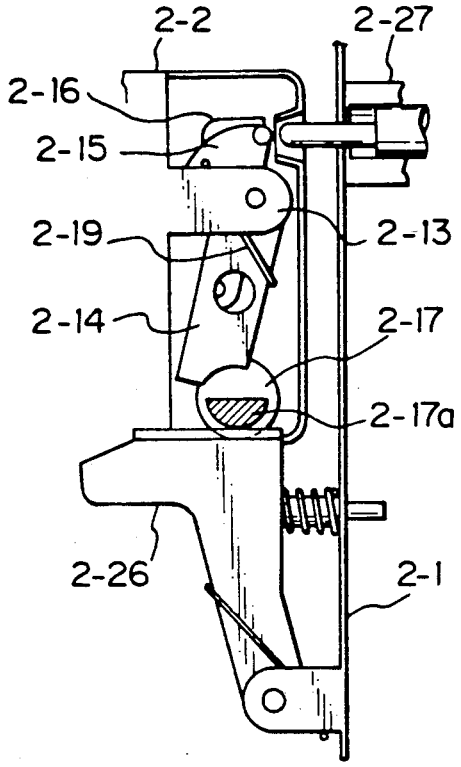
FIGS. 14, 15 an 16 are side elevations demonstrating how the alternative embodiment is mounted and dismounted from the copier body.

A relationship between the developing unit 2-2 and the copier body 2-1 will be described. As shown in FIG. 8, the developing unit 2-2 is inserted in the copier body 2-1 along guide members, not shown. As shown in FIG. 14, the semicircular lug 2-17*a* of the gear 2-17 is rotated by 180 degrees by a rack 2-26 which is mounted on the copier body 2-1. As soon as the toner chamber 2-10 runs out of toner, the toner end condition is displayed and, at the same time, a solenoid 2-27 provided on the copier body 2-1 is engergized to urge the arm 2-16. Then, the arm 2-16 rotates the ratchet wheel 2-15 by one tooth with its pawl 2-22. Every time the toner end signal appears, the ratchet wheel 2-15 is rotated by one tooth. When a predetermined number of toner cartridges are used, the pin 2-15*a* of the ratchet wheel 2-15 rotates the arm 2-14 counterclockwise (position shown in FIG. 15) and thereby causes it to pull the piano wire 2-23 as indicated by an arrow.

Figure 17:
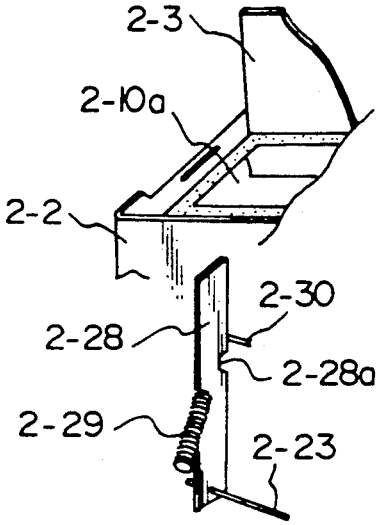
FIGS. 17 and 18 are perspective views showing a mechanism for preventing a toner cartridge from being mounted.
Figure 18:
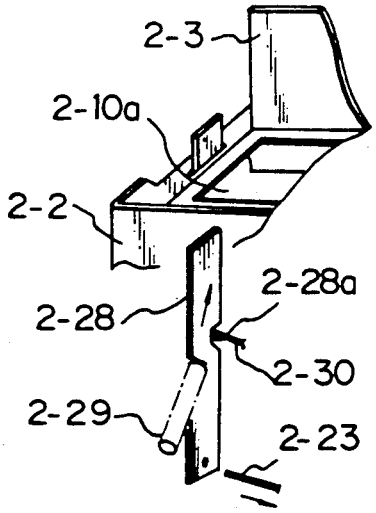

Referring to FIGS. 17 and 18, a mechanism for preventing a toner cartridge from being loaded in the developing unit 2-2 will be described. Usually, the user puts the toner cartridge 2-4, FIG. 8, in the toner chamber 2-10*a* by opening the cover 2-3. However, when the arm 2-14 pulls the piano wire 2-23 in response to the last toner end condition as started above, the piano wire 2-23 is pulled out from a locking plate 2-28 which extends upward from the toner chamber 2-10*a*. Consequently, the locking plate 2-28 is raised by a spring 2-29 until a stepped portion 2-28*a* thereof has been caused to mate with a stop 2-30, whereby the plate 2-28 is locked in the raised position.

Figure 16:
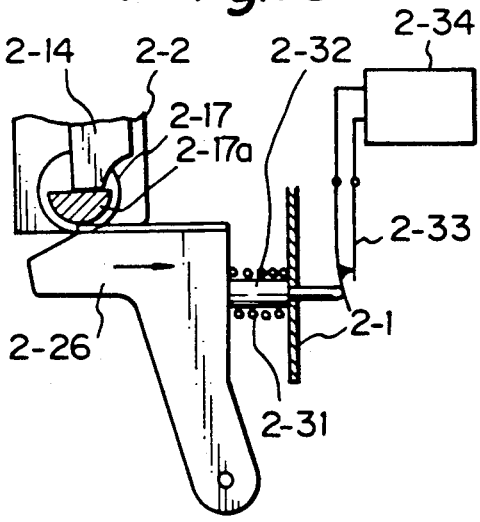
Figure 19:
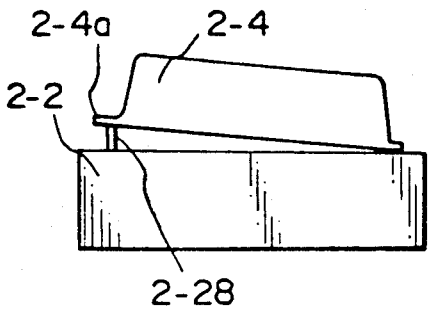
FIG. 19 is a side elevation representative of a condition in which a toner cartridge cannot be mounted.

FIG. 19 indicates how the toner cartridges 2-4 is prevented from being mounted on the developing unit 2-2. As shown, when the locking plate 2-28 is raised as stated above, the toner cartridge 2-4 abuts against the plate 2-28 at one end 2-4*a* thereof and is thereby prevented from being loaded in the developing unit 2-2. At the same time, the developing unit 2-2 itself is prevented from being inserted in the copier body 2-1. Specifically, when one tries to insert the developing unit 2-2 in the copier body 2-1, the lower end of the arm 2-14 having been rotated as shown in FIG. 16 abuts against the flat edge of the semicircular lug 2-17*a* of the gear 2-17. Hence, the gear 2-17 cannot rotate and simply urges the rack 2-26. As a result, a pin 2-31 studded on the rack 2-26 abuts against the copier body 2-1 at a shoulder thereof, preventing the rack 2-26 from being urged any further. The developing unit 2-2, therefore, cannot be set in an operative position in the copier body 2-1. The reference numeral 2-32 designates a spring for returning the rack 2-26. Further, as the tip of the pin 2-31 turns on a switch 2-33, a display 2-34 is energized to alert the user to the inhibited state.

Figure 20:
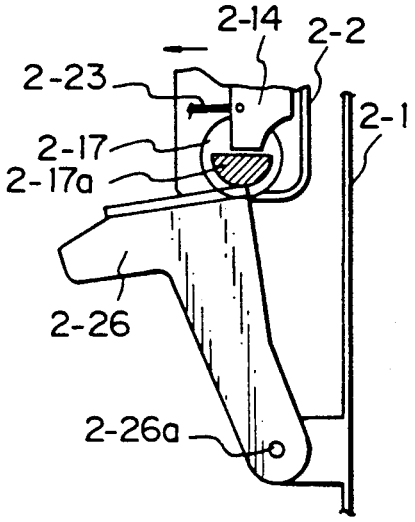
FIG. 20 is a side elevation showing how the alternative embodiment is pulled out from the copier body after a toner end condition has been reached.

FIG. 20 shows how the developing unit 2-2 is pulled out from the copier body 2-1 when the last toner end condition is reached. As shown, when the gear 2-17 cannot rotate, the rack 2-26 is rotated counterclockwise about a fulcrum 2-26*a* to allow the developing unit 2-2 to be pulled out from the copier body 2-1.

As stated above, once the last toner cartridge 2-4 usable with the developing unit 2-2 is emptied, the developing unit 2-2 cannot be loaded in the copier body 2-1 again. This inhibits one from using the developing unit 2-2 whose life has expired by loading it with a toner of another machine or a toner collected by cleaning, thereby eliminating machine troubles and unusual images. In addition, the user can clearly see the time for replacing the developing unit 2-2. The toner transport member 2-11 and the ratchet wheel 2-15 serve as detecting means and a counter, respectively. The arm 2-14 and the gear 2-17 which is locked in mesh with the copier body 2-1 by the arm 2-14 serve as preventing means in combination.

THIRD EMBODIMENT

Figure 21:
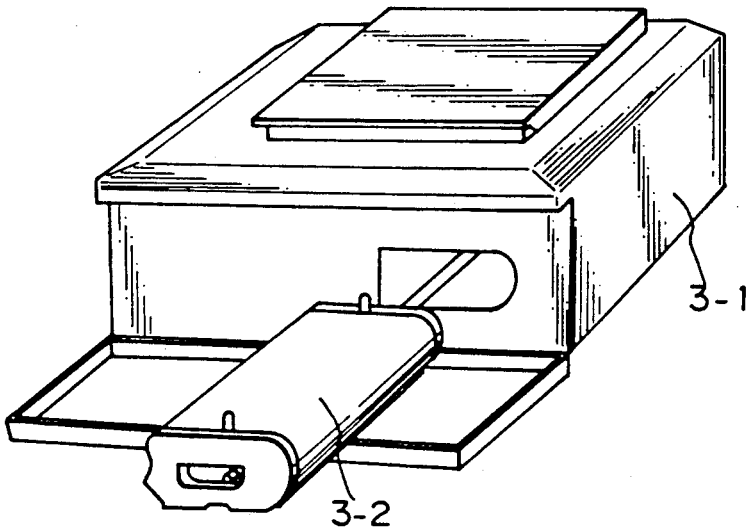
FIG. 21 is a perspective view of another alternative embodiment of the present invention and a copier body with which is usable.
Figure 22:
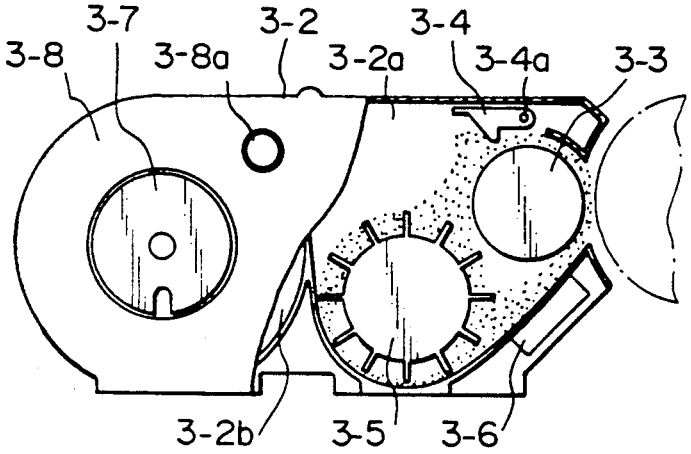
FIGS 22 and 23 are side elevations showing a developing chamber of the embodiment shown in FIG. 21 and its neighborhood.
Figure 23:
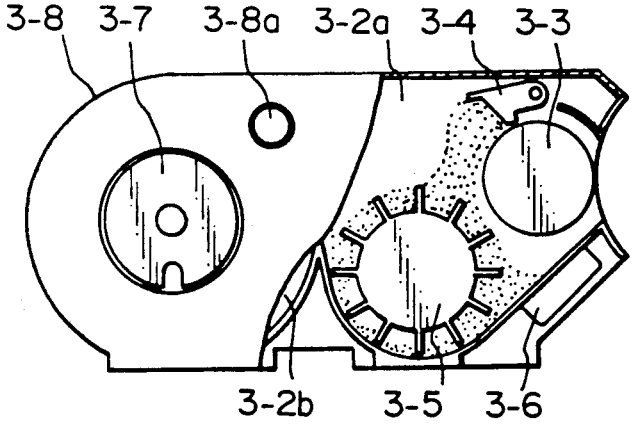

Referring to FIG. 21, another alternative embodiment of the present invention is shown. As shown a copier body 3-1 has a front cover which is openable to accommodate a developing unit 3-2 in the copier body 3-1. As shown in FIG. 22 and 23, the developing unit 3-2 has a developing chamber 3-2*a* and a toner chamber 3-2*b*. The developing chamber 3-2*a* has thereinside a developing roller 3-3 which accommodates magnets thereinside, a doctor blade 3-4 for regulating the thickness of a developer layer formed on the roller 3-3, and a paddle wheel 3-5 for supplying a developer to the roller 3-3. A sensor 3-6 is mounted on the outside of the developing chamber 3-2*a*. A toner agitating member 3-7 is disposed in the toner chamber 3-2*b*. A cover 3-8 is affixed to the side panels of the developing unit 3-2 after the various components and structural elements of the unit 3-2 have been mounted on the side panels. The cover 3-8 has an opening 3-8*a*. The doctor blade 3-4 is connected substantially intergrally to an arm, which will be described, by a shaft 3-4*a*. When the developing unit 3-2 is inhibited from being used, the doctor blade 3-4 is positioned as shown in FIG. 23 so as to prevent the developer layer from being formed on the developing roller 3-3, as will be described more specifically later.

Figure 24:
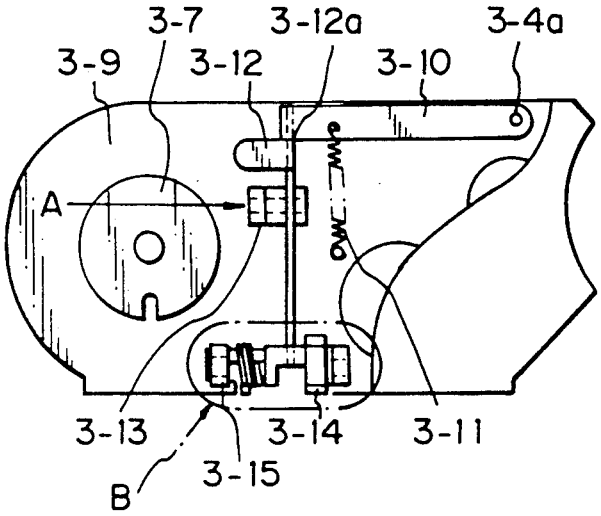
FIGS. 24 and 25 are sectional side elevations of an essential part of the illustrative embodiment shown in FIG. 21.
Figure 25:
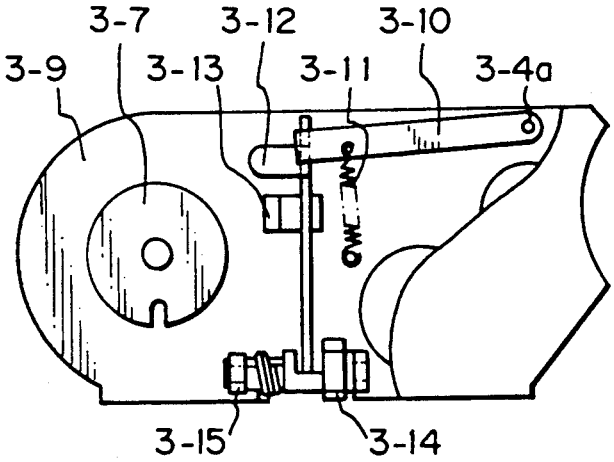

FIGS. 24 and 25 are fragmentary views of the developing unit 3-2. As shown, the developing unit 3-2 has a side panel 3-9 and an arm 3-10 which is supported by the shaft 3-4*a*. A spring 3-11 is anchored at one end to the arm 3-10 to constantly bias the arm 3-10 counterclockwise as viewed in FIG. 24. An arm 3-12 is rotatably supported by a bearing portion 3-13 and has a shoulder 3-12*a* at the upper end thereof. The free end of the arm 3-10 is retained by the shoulder 3-12*a* of the arm 3-12. A gear 3-14 is located adjacent to the lower end of the arm 3-12 and supported by a bearing portion 3-15. The doctor blade 3-4 shown in FIGS. 22 and 23 are supported integrally with the arm 3-10 which is located outside of the side panel 3-9, as started earlier. The spring 3-11 constantly biases the doctor blade 3-4 counterclockwise about the shaft 3-4*a*, but the rotation of the doctor blade 3-4 is prevented by the arm 3-12 (FIG. 24.). In this condition, the developing roller 3-3 and the doctor blade 3-4 are spaced apart from each other by a distance which is necessary for developing a latent image fromed on a photoconductive element (FIG. 22). When the arm 3-10 is positioned as shown in FIG. 25, the doctor blade 3-4 is shifted to a position where it contacts the developing roller 3-3, as shown in FIG. 23.

Figure 26:
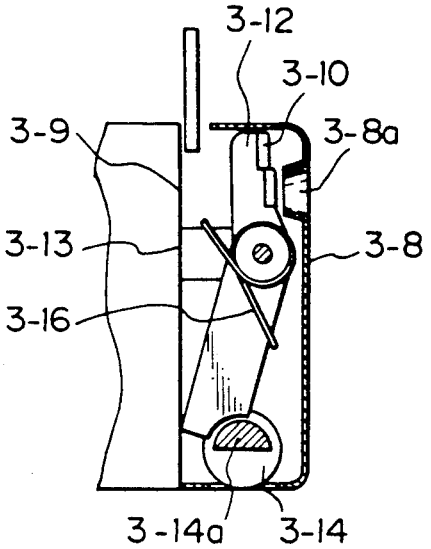
FIG. 26 is a view as seen in a direction indicated by an arrow A in FIG. 24.
Figure 27:
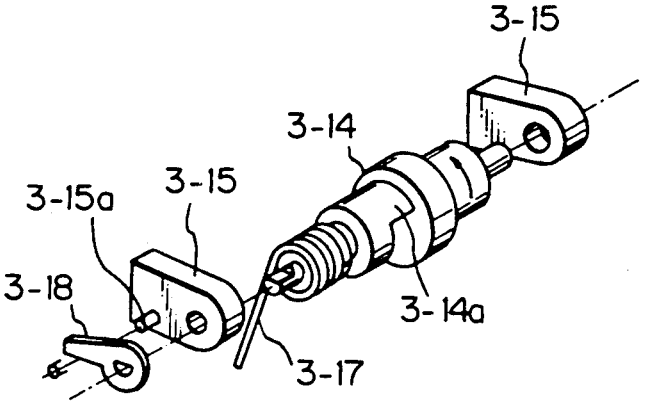
FIG. 27 is an exploded perspective view showing a gear and its associated members.

FIG. 26 is a view as seen in a direction indicated by an arrow A in FIG. 24. Although the arm 3-12 tends to rotate clockwise under the action of the spring 3-16, it is stopped by the side panel 3-9. The arm 3-10 is retained by the shoulder 3-12*a* of the arm 3-12. FIG. 27 is a view of a particular portion which is labled B in FIG. 24. As shown, while a coiled torsion spring 3-17 constantly biases the gear 3-14 in a direction indicated by an arrow, the gear 3-14 is prevented from rotating because a pin 3-15*a* studded on the bearing portion 3-15 abuts against and arm 3-18 which is rotatable integrally with the gear 3-14. In this instance, a semicircular lug 3-14*a* provided on the gear 3-14 is positioned such that its flat edge faces downward.

Before the developing unit 3-2 is inserted in the copier body 3-1, the arm 3-12 and the semicircular lug 3-14*a* of the gear 3-14 are positioned relative to each other as shown in FIG. 26. Specifically, since the arm 3-12 and the lug 3-14*a* are engaged with each other, the arm 3-12 cannot rotate clockwise. This inhibits a person from intentionally pressing the arm 3-12 through the opening 3-8*a* cover 3-8 or prevents the arm 3-12 from being rotated by vibrations during the course of transport.

Figure 28:
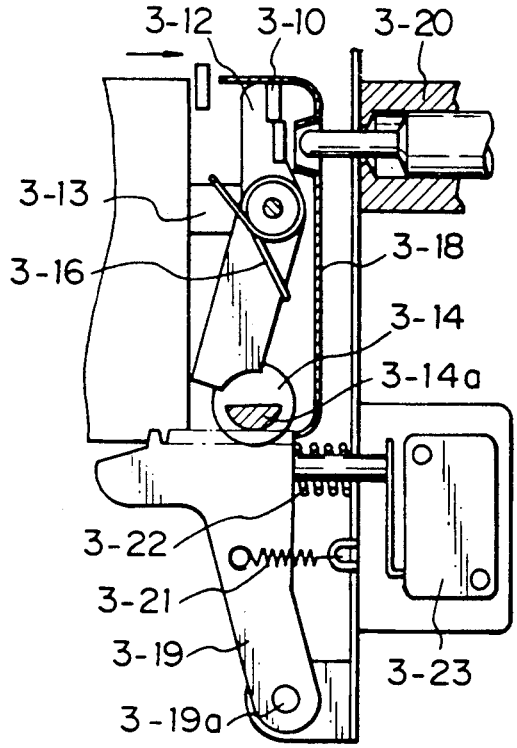
FIG. 28 is a sectional side elevation showing the embodiment of FIG. 21 in a position mounted on the copier body.

As shown in FIG. 28, when the developing unit 3-2 is inserted in the copier body 3-1 as indicated by an arrow, the gear 3-14 is brought into mesh with a rack 3-19 mounted on the copier body 3-1 and is thereby caused to rotate half a rotation. Consequently, the semicircular lug 3-14*a* of the gear 3-14 is positioned as shown in FIG. 28, i.e., its flat edge faces upward. Then, the arm 3-12 is allowed to rotate counterclockwise. Although the rack 3-19 is rotatably supported by a fulcrum 3-19*a*, it is held in the position of FIG. 28 by a spring 3-22 and, therefore, causes the gear 3-14 to rotate as mentioned above.

When the developing unit 3-2 is pulled out of the copier body 3-1 for the purpose of changing the color, the position shown in FIG. 26 is set up again.

Figure 29:
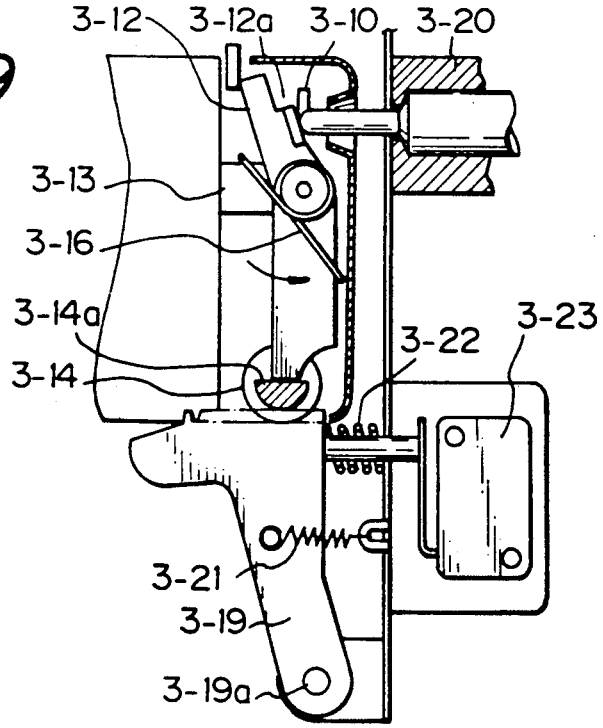
FIG. 29 is a sectional side elevation demonstrating the operation of a solenoid.

Assume that a solenoid 3-20 mounted on the copier body 3-1 is energized. Then, as shown in FIG. 29, the solenoid 3-20 rotates the arm 3-12 counterclockwise with the result that the arm 3-10 is released from the shoulder 3-12*a* of the arm 3-12, as shown in FIGS. 25 and 29. Hence, the arm 3-12 is prevented from restoring clockwise under the action of the spring 3-16. At the same time, the doctor blade 3-4 rotated integrally with the arm 3-12 to abut against the developing roller 3-3, as shown in FIG. 23. In such a position, the doctor blade 3-4 prevents a developer layer from being formed on the roller 3-3.

Figure 30:
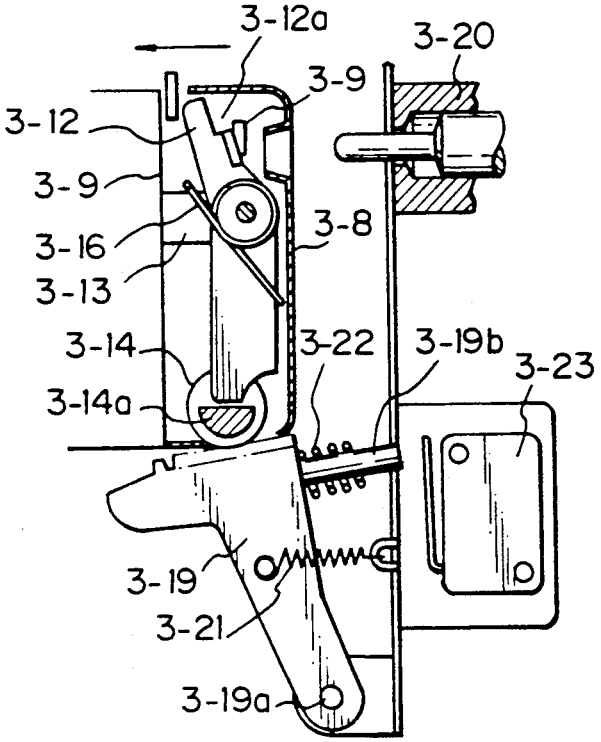
FIG. 30 is a sectional side elevation representative of a condition in which the embodiment of FIG. 21 is pulled out from the copier body with the gear being locked.

FIG. 30 shows a condition wherein the developing unit 3-2 is pulled out of the copier body 3-1. Specifically, although the gear 3-14 is prevented from rotating by the gear 3-14, the rack 3-19 in mesh with the gear 3-14 is rotated counterclockwise about the fulcrum 3-19*a* against the action of the spring 3-21. In this condition, one can pull out the developing unit 3-2 from the developing unit 3-2.

Figure 31:
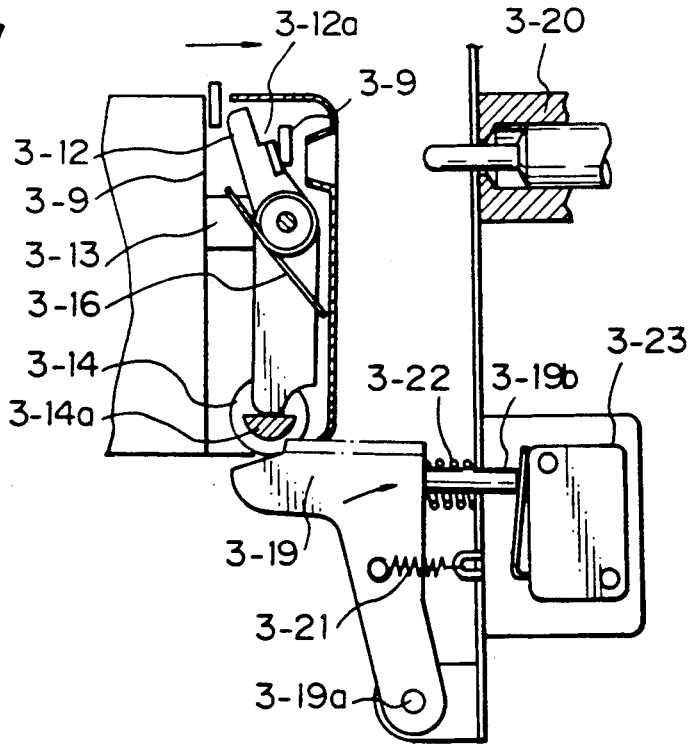
FIG. 31 is a sectional side elevation showing a condition in which the embodiment of FIG. 21 is inhibited from being mounted on the copier body.

How the developing unit 3-2 whose life has expired is prevented from being loaded in the copier body 3-1 will be described with reference to FIG. 31. When one intends to insert such an unusable developing unit 3-2 in the copier body 3-1, the developing unit 3-1 has been conditioned as shown in FIG. 30. Since the arm 3-12 prevents the gear 3-14 from rotating, the force being exerted by the person on the developing unit 3-2 causes the rack 3-19 to rotate clockwise about the fulcrum 3-19*a*. As a result, a lug 3-19*b* extending from the rack 3-19 enters the copier body 3-1 to press an actuator of a switch 3-23. In response, the copier body 3-1 displays a message or otherwise warns the person not to mount the inadequate developing unit 3-2. This, coupled with the physical resistance acting against the insertion of the developing unit 3-2, allows the person to see that the unit 3-2 should not be used. Although the spring 3-22 is compressed, it will restore the rack 3-19 when the developing unit 3-2 is removed. The force of the spring 3-22 is selected to be greater than the spring 3-21 so as not to disturb the rotation of the gear 3-14 of the developing unit 3-2 when the latter is still usable. It is to be noted that the arm 3-12 and the gear 3-14 operated by the arm 3-12 to be locked in mesh with the rack 3-19 constitute preventing means in combination.

In summary, it will be seen that the present invention provides a developing unit which inhibits one from loading the unit with a developer after the expiration of its service life. The present invention, therefore, eliminates troubles and unusual images ascriable to the use of a developing unit which has reached the end of its life, while clearly informing a person of the time for replacement of such a developing unit.

The present invention also inhibits one from loading a machine body with a developing unit whose life has expired. This is also successful in eliminating troubles and unusual images ascribable to the use of a developing unit whose life has expired, while clearly informing a person of the time for replacement.

Further, since a developing unit reached the end its life is prevented from being mounted in a machine body later more as stated above, the deposition of a carrier due to the short supply of toner and, therefore, troubles ascribable to the deposition of a carrier are precluded. This frees the user of extra maintenance cost.

Various modifications will become possible for those skilled in the art after receiving the teachings of the present disclosure without departing from the scope thereof.

What is claimed is:

1. A developing unit removably mounted on an image recording apparatus, comprising:

a developer chamber for storing a developer fed from the outside;

detecting means for detecting an amount of the developer remaining in said developer chamber;

a counter operated by an output signal of said detecting means;

a cover member openably closing said developer chamber; and locking means for locking said cover member when said counter reaches a predetermined value.

2. A developing unit according to claim 1, wherein said counter comprises a ratchet wheel.

3. A developing unit according to claim 1, wherein a hole is formed in said cover and wherein said locking means comprises a spring-biased lug member engageable with said hole.

4. A developing unit according to claim 3, further comprising a wire slideably received by said locking means, said wire prohibiting engagement of said spring-biased lug member with the hole formed in said cover until said counter reaches said predetermined value.

5. A developing unit removably mounted on an image recording apparatus, comprising:

a developer chamber for storing a developer fed from the outside;

detecting means for detecting an amount of the developer remaining in said developer chamber;

a counter operated by an output signal of said detecting means; and preventing means for preventing said developing unit from being mounted again on a body of said image recording apparatus when said counter reaches a predetermined value.

6. A developing unit accroding to claim 5, wherein said detecting means includes a rotatable toner transport member.

7. A developing unit according to claim 5, wherein said counter comprises a ratchet wheel.

8. A developing unit according to claim 5, further comprising an openable and recloseable cover adapted to allow transfer of a toner from a toner cartridge to said developing unit.

9. A developing unit according to claim 8, further comprising a spring-biased locking plate which prevents a toner cartridge from being mounted on the developing unit when said counter reaches said predetermined value.

10. A developing unit according to claim 9, further comprising a wire maintaining said spring-biased locking plate in an unlocked position until said counter reaches said predetermined value.

11. A developing unit according to claim 5, wherein said preventing means includes an arm pivotably mounted on said developing unit.

12. A developing unit according to claim 11, further comprising a gear having a semicircular lug provided thereon, said arm being pivotable to abut said semicircular lug to prevent said developing unit from being mounted on said image forming apparatus.

13. An image forming apparatus, comprising:

a developing unit having a developing chamber and a toner chamber, said developing unit being removably inserted in said image forming apparatus;

sensor means for detecting a toner condition in said developing unit; and means for converting said developing unit to a disabled developing unit in response to an unsatisfactory toner condition sensed by said sensor means;

wherein said disabled developing unit can be removed from said image forming apparatus, but wherein said disabled developing unit is prohibited from reinsertion into said image forming apparatus.

14. An image forming apparatus according to claim 13, wherein said developing unit includes an arm and a gear, and wherein said arm is engageable with said gear to disable said developing unit.

15. An image forming apparatus acccording to claim 14, further comprising a semicircular lug provided on said gear, said semicircular lug having a flat side.

16. An image forming apparatus according to claim 15, wherein said arm has a flat surface engageable with said flat side of said semicircular lug to prevent rotation of said gear.

17. An image forming apparatus according to claim 14, further comprising a rack pivotably mounted on a fulcrum and engaged with said gear, said rack rotating about said fulcrum in response to an attempted insertion of a disabled developing unit.

* * * * *